US005188163A

United States Patent [19]

Schwartzengraber et al.

[11] Patent Number: 5,188,163

[45] Date of Patent: Feb. 23, 1993

[54] BRACKET ASSEMBLY FOR AN OVERHEAD DOOR

[75] Inventors: Donald Schwartzengraber, Defiance, Ohio; Robert G. Schram, Beaconsfield, Canada

[73] Assignee: Napoleon Spring Works, Inc., Archbold, Ohio

[21] Appl. No.: 858,628

[22] Filed: Mar. 27, 1992

[51] Int. Cl.[5] ..... E06B 3/48

[52] U.S. Cl. ..... 160/229.1; 160/201

[58] Field of Search ..... 248/284, 286; 160/201, 160/188, 229.1

[56] References Cited

U.S. PATENT DOCUMENTS

| | | | |
|---|---|---|---|
| 2,883,182 | 4/1959 | Bornemann | 160/201 X |
| 3,484,812 | 12/1969 | Holland | 160/201 |
| 4,269,253 | 5/1981 | Ziegler | 160/201 |

*Primary Examiner*—Ramon O. Ramirez

*Attorney, Agent, or Firm*—Emch, Schaffer, Schaub & Porcello Co.

[57] ABSTRACT

A bracket assembly for an overhead door including a first portion having a first base and at least two first portion rails having a plurality of openings. At least two arm attachment projections extending outwardly from the first base substantially parallel to the rails each including an opening. The assembly further including a second portion having a second base and at least two second portion rails having a plurality of openings. The second portion also includes at least two pivot pin receiving projections each having at least one opening. A third portion of the bracket assembly includes a third base having at least two third portion projections having at least one opening. The third portion can be attached to the second portion by a pivot pin.

13 Claims, 4 Drawing Sheets

BRACKET ASSEMBLY FOR AN OVERHEAD DOOR

BACKGROUND ART

The present invention is directed generally to a bracket assembly for an overhead door. More particularly, the invention is directed to a bracket for use with a multiple panel overhead door in which one portion of the bracket is attached to a panel of the door and a separate portion of the bracket is attached to another panel of the door. The bracket assembly of the present invention is usually connected to the traveling arm of an automatic overhead door system.

Prior art brackets for use with automatic overhead door systems are usually one piece brackets that are attached to a single panel of a multiple panel overhead door. This type of attachment results in a great deal of stress being placed on the single panel of the door as it is being raised and lowered by the door system due to the weight of the door. The stress causes the panels of the door to separate over time. The cost of replacing a damaged overhead door is costly. The present invention is directed to a bracket assembly that can eliminate the above described damage to an overhead door by distributing the weight of the door over two separate door panels as the door is raised and lowered by the door system.

DISCLOSURE OF INVENTION

The present invention is directed to a bracket assembly for an overhead door. The bracket includes a first portion having a first base. The first portion also includes at least two first portion rails, which are substantially perpendicular to the first base, having a plurality of openings. At least two arm attachment projections extend outwardly from the first base substantially parallel to the rails. These projections each include an opening. The traveling arm of an automatic door system can be attached to the projections.

The assembly further includes a second portion having a second base. The second portion includes at least two second portion rails, which are substantially perpendicular to the second base, having a plurality of openings. The second portion also includes at least two pivot pin receiving projections substantially perpendicular to the second base. The projections each have at least one opening. The second portion can be attached to the first portion by bolts.

A third portion of the bracket assembly includes a third base. The third portion includes at least two third portion projections, which are substantially perpendicular to the third base, each having at least one opening. The third portion can be attached to the second portion by a pivot pin.

It is the primary object of the present invention to provide a bracket assembly for an overhead door.

It is a major object of the present invention to provide a bracket assembly for an overhead door that prevents damage to the panels of an overhead door.

Other objects and advantages will become apparent as the invention is described hereinafter in detail with reference being made to the accompanying drawings.

BEST MODE OF CARRYING OUT INVENTION

Figure 1:
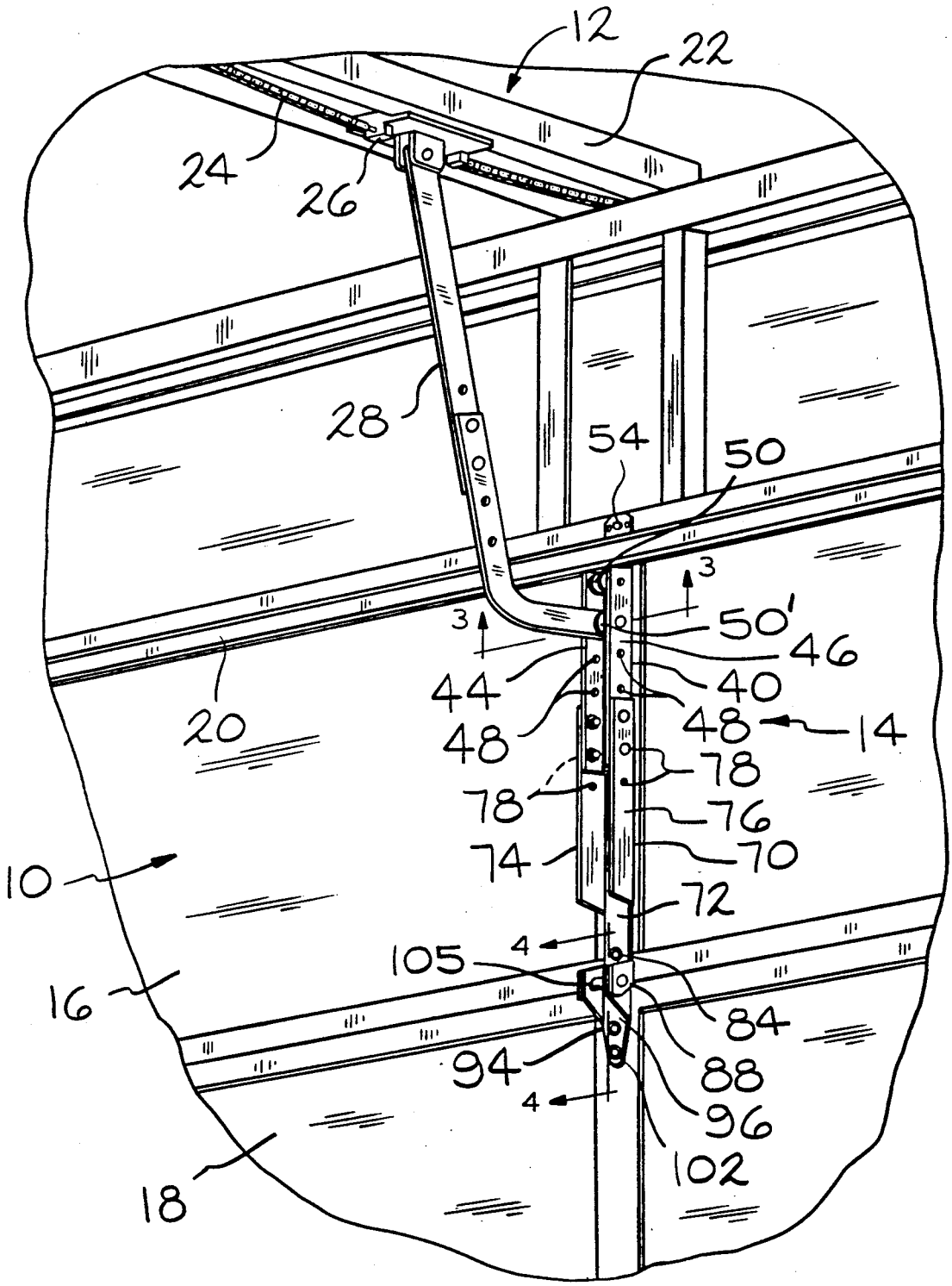
FIG. 1 is a perspective view of an embodiment of the present invention attached to an overhead door and an overhead door system.

Referring now to the drawings, the preferred embodiments of the present invention are shown. Referring to FIG. 1, an overhead door 10, an automatic door system 12 and the bracket assembly 14 are shown. The door 10 includes multiple panels 16 and 18. The door further includes a flange 20.

Figure 6:
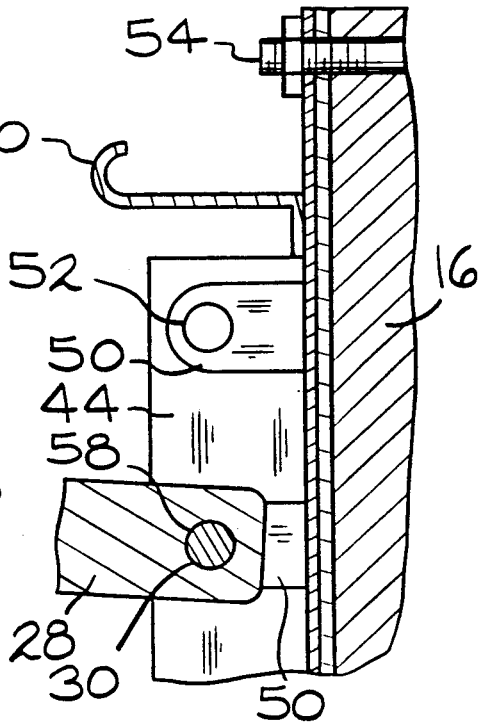
FIG. 6 is a cross-sectional view taken along line 6—6 of FIG. 3.

The automatic door system 12, also commonly called an automatic door opener, includes a track 22 and a chain 24. A bracket 26 is mounted on the track 22 and connected to the chain 24. The bracket 26 is connected to a traveling arm 28 having an opening 30 at its distal end (FIG. 6). The chain 24 is operatively connected to an electric motor (not shown) which when energized moves the chain 24 and thereby the bracket 26 and the arm 28.

Figure 2:
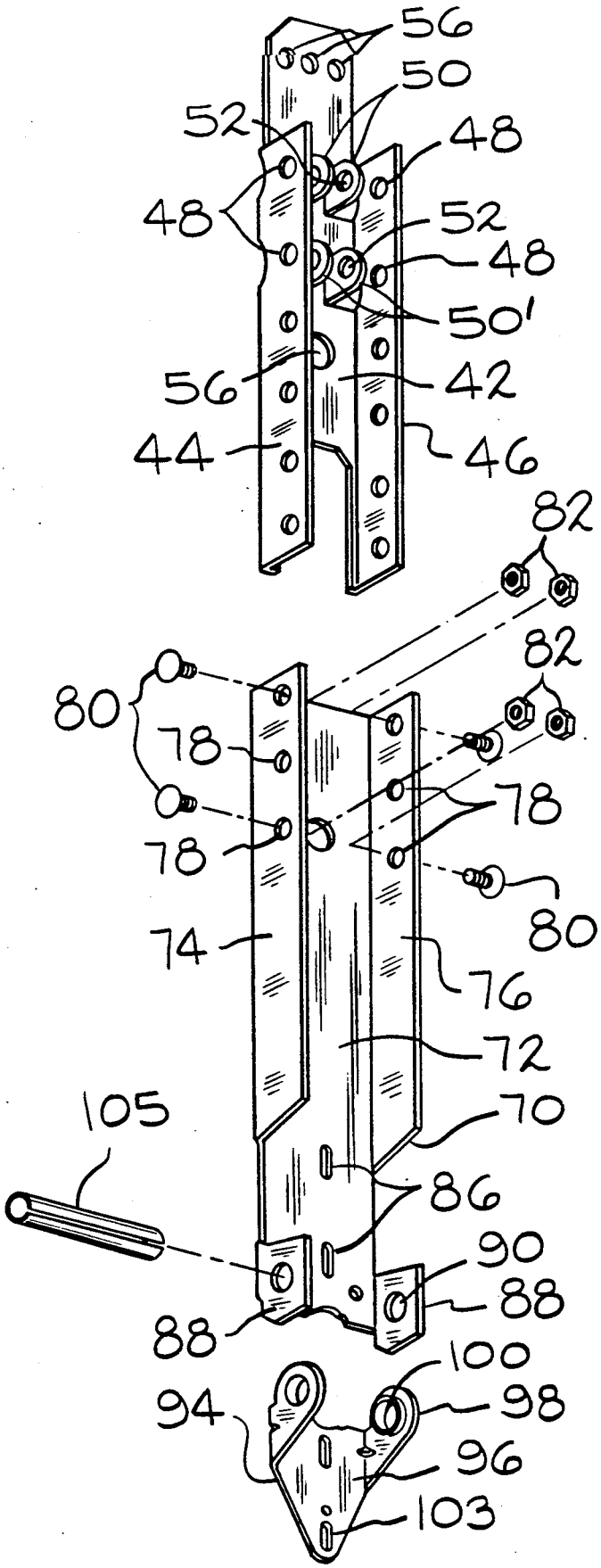
FIG. 2 is an exploded view of the preferred embodiment of the present invention.

Referring to FIGS. 1 and 2, the bracket assembly 14 of the present invention is shown. The bracket assembly 14 includes a first portion 40. The first portion has a first base 42. The first portion further has at least two first portion rails 44 and 46 which are substantially perpendicular to the first base 42. The rails 44 and 46 each include a plurality of openings 48. At least two pairs of arm attachment projections 50 and 50' extend outwardly from the first base 42 substantially parallel to the rails 44 and 46. The projections 50 each include openings 52. The first portion is attached to the panel 16 of the door 10 by at least one bolt 54 that extends through openings 56 on the first base 42.

Figure 3:
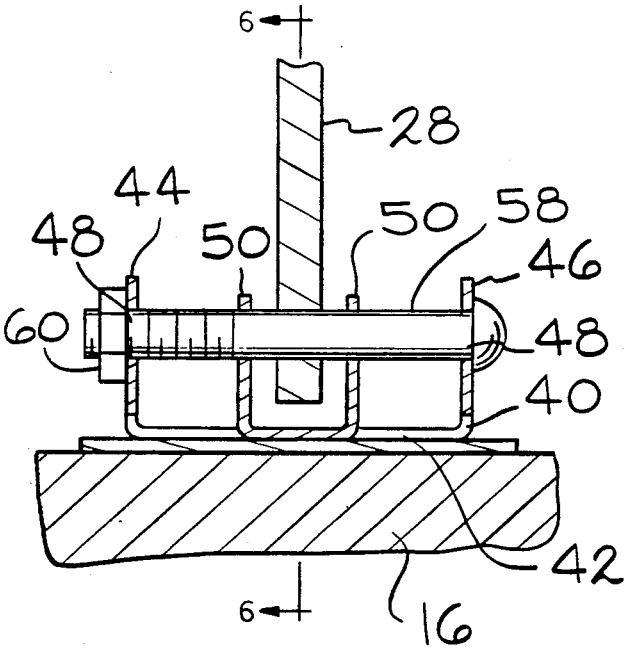
FIG. 3 is a cross-sectional view taken along line 3—3 of FIG. 1.

Referring to FIGS. 1, 3 and 6, the connection of the traveling arm 28 of the door system 12 to the first portion 40 is shown. The arm 28 is placed between two projections 50 of the first portion 40. A threaded bolt 58 is placed through two opposite openings 48 in the rails 44 and 46, the openings 52 in the arm attachment projections 50 and the opening 30 in the arm 28. A threaded nut 60 is attached to the bolt 58 to hold the bolt firmly in place. In the present embodiment, two pairs of projections 50 and 50' are shown. The arm 28 can be attached to either pair of projections depending on the application.

Referring to FIGS. 1 and 2, the second portion 70 includes a second base 72. The second portion 70 further includes at least two second portion rails 74 and 76. The rails 74 and 76 are substantially perpendicular to the second base 72. The rails 74 and 76 each include a plurality of openings 78. As shown in FIG. 2, the openings 78 of rails 74 and 76 can be lined-up with the openings 48 in rails 44 and 46 when attaching the first portion 40 to the second portion 70. Threaded bolts 80 can be inserted through the respective openings in the respective rails and fixed into place by threaded nuts 82. The rails 44, 46, 74 and 76 can be arranged in various ways depending on the application.

Referring to FIGS. 1 and 2, the second portion can be attached to the panel 16 of the door 10 by inserting at least one bolt 84 through openings 86 in the second base 72. The second portion 70 is usually attached to the same door panel as the first portion 40.

Figure 4:
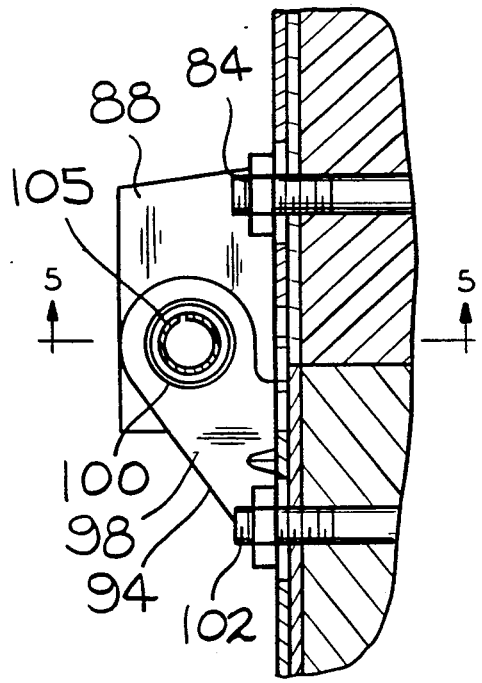
FIG. 4 is a cross-sectional view taken along line 4—4 of FIG. 1.
Figure 5:
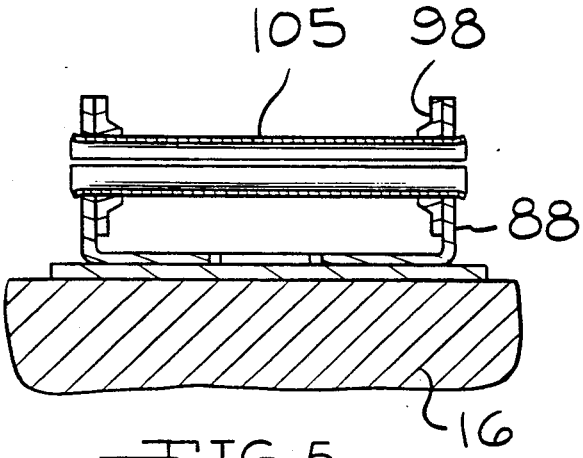
FIG. 5 is a cross-sectional view taken along line 5—5 of FIG. 4.

As shown in FIGS. 1, 2 and 4, the second portion 70 further includes at least two pivot pin receiving projections 88. The projections 88 are substantially perpendicular to the second base 72. The projections 88 each have at least one opening 90.

Figure 7:
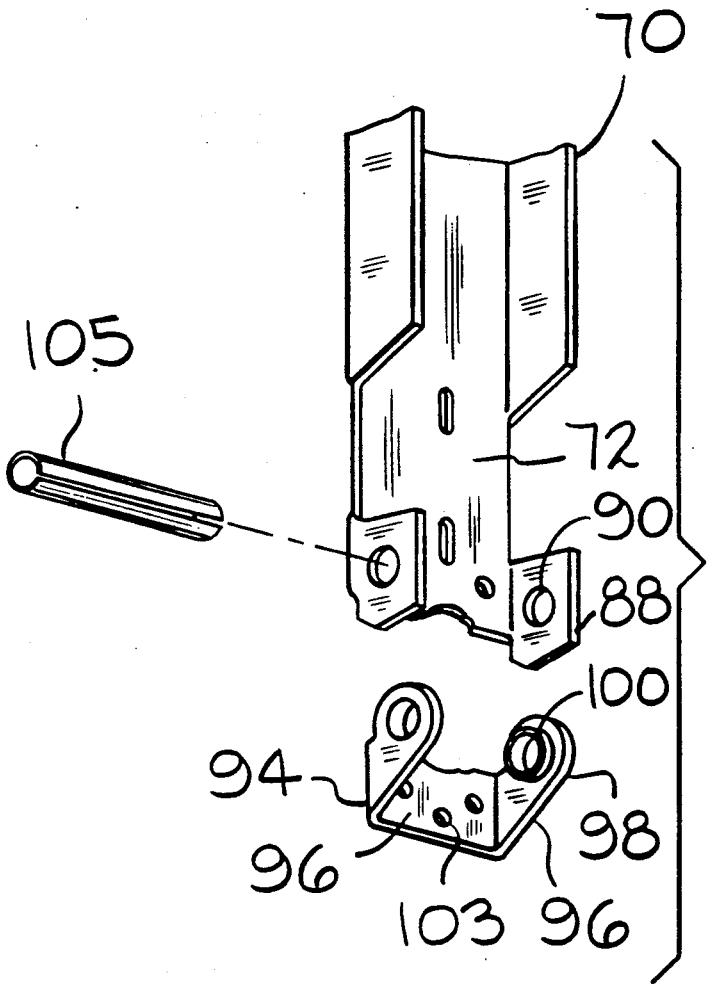
FIG. 7 is an exploded view of another embodiment of the third portion of the present invention and its connection to the second portion of the present invention.

Referring to FIG. 2, the third portion 94 of the bracket 14 is shown. The third portion 94 has a third base 96. The third portion 94 further has at least two third portion projections 98 having openings 100. The projections 98 are substantially perpendicular to the third base 96. The third portion is attached to a door panel by at least one bolt 102 extending through an opening 103 in third base 96 as shown in FIGS. 1 and 4. A second embodiment third portion is shown in FIG. 7.

Referring to FIGS. 1, 2, 4 and 5, the third portion is attached to the second portion by inserting a pivot pin 105 through the third portion projection openings 100 and pivot pin receiving projection openings 90 of the second portion. The ends of the pivot pin 105 are flared to maintain the pin in position. The pivot pin 105 allows the second portion 70 and the third portion 94 to pivot with respect to one another as the overhead door 10 is raised and lowered.

The third portion 94 is usually attached to a separate door panel than the one to which the first and second portions 40 and 70 are attached. In the present embodiment, as shown in FIG. 1, the first and second portions 40 and 70 are attached to a first panel 16 and the third portion 94 is attached to a second panel 18.

It should be understood that many changes can be made to the present bracket assembly as disclosed in the drawings and still fall within the scope of the following claims.

We claim:

1. A bracket assembly for an overhead door comprising, in combination:

a first portion, said first portion having a first base, said first base having means for attaching said first portion to a panel of an overhead door, said base portion having means for attaching said first portion to an arm of an overhead door system;

a second portion, said second portion having a second base, said second base having means for attaching said second portion to said panel of said overhead door, said second portion having means to attach said second portion to said first portion;

a third portion, said third portion having a third base, said third base having means for attaching said third portion to a second panel of said overhead door, said second portion having means to attach said third portion to said second portion.

2. The bracket assembly of claim 1, wherein said means for attaching said first portion to said panel of an overhead door is at least one bolt.

3. The bracket assembly of claim 1, wherein said first portion has at least two first portion rails, said first portion rails being substantially perpendicular to said first base, said first portion rails each including a plurality of openings.

4. The bracket assembly of claim 3, wherein said means for attaching said first portion to said arm are at least two arm attachment projections extending outwardly from said first base substantially parallel to said rails, said arm attachment projections each including an opening, an opening in said arm, and a bolt extending through at least two opposite openings in said first portion rails, said openings in said arm attachment projections and said opening in said arm.

5. The bracket assembly of claim 1, wherein said means for attaching said second portion to said panel of an overhead door is at least one bolt.

6. The bracket assembly of claim 3, wherein said second portion has at least two second portion rails, said second portion rails being substantially perpendicular to said second base, said second portion rails each including a plurality of openings.

7. The bracket assembly of claim 6, wherein said means to attach said second portion to said first portion are bolts extending through corresponding openings in said first portion rails and said second portion rails.

8. The bracket assembly of claim 1, wherein said second portion further includes at least two pivot pin receiving projections, said pivot pin receiving projections being substantially perpendicular to said second base, said pivot pin receiving projections each having at least one opening.

9. The bracket assembly of claim 1, wherein said means for attaching said third portion to said panel of an overhead door is at least one bolt.

10. The bracket assembly of claim 8, wherein said third portion has at least two third portion projections, said third portion projections being substantially perpendicular to said third base, said third portion projections each including at least one opening.

11. The bracket assembly of claim 10, wherein said means to attach said third portion to said second portion is a pivot pin extending through said openings in said pivot pin receiving projections of said second portion and said openings in said third portion projections.

12. A bracket assembly for an overhead door comprising, in combination:

a first portion, said first portion having a first base, said first portion further having at least two first portion rails, said rails being substantially perpendicular to said first base, said rails each including a plurality of openings, said first portion further having at least two arm attachment projections extending outwardly from said first base substantially parallel to said rails, said projections each including an opening;

a second portion, said second portion having a second base, said second portion further having at least two second portion rails, said rails being substantially perpendicular to said second base, said rails each including a plurality of openings, said second portion further having at least two pivot pin receiving projections, said projections being substantially perpendicular to said second base, said projections each having at least one opening, said second portion being attached to said first portion;

a third portion, said third portion having a third base, said third portion further having at least two third portion projections, said projections being substantially perpendicular to said third base, said projections each including at least one opening, said third portion being attached to said second portion.

13. The bracket assembly of claim 12, wherein said first and second portions are attached to a panel of an overhead door having multiple panels and said third portion is attached to another panel of said overhead door.

* * * * *